US009903270B2

(12) United States Patent
McClearen et al.

(10) Patent No.: US 9,903,270 B2
(45) Date of Patent: Feb. 27, 2018

(54) CYLINDER ARRANGEMENT FOR OPPOSED PISTON ENGINE

(71) Applicant: AVL Powertrain Engineering, Inc., Plymouth, MI (US)

(72) Inventors: James McClearen, Brighton, MI (US); Jeffrey Wayne Klaver, Ypsilanti, MI (US); Gary L. Hunter, Dexter, MI (US)

(73) Assignee: AVL POWERTRAIN ENGINEERING, INC., Plymouth, MI (US)

( * ) Notice: Subject to any disclaimer, the term of this patent is extended or adjusted under 35 U.S.C. 154(b) by 129 days.

(21) Appl. No.: 14/815,215

(22) Filed: Jul. 31, 2015

(65) Prior Publication Data

US 2016/0032823 A1 Feb. 4, 2016

Related U.S. Application Data

(60) Provisional application No. 62/031,935, filed on Aug. 1, 2014.

(51) Int. Cl.
*F02B 75/28* (2006.01)
*F02B 75/02* (2006.01)

(52) U.S. Cl.
CPC ..... *F02B 75/28* (2013.01); *F02B 75/02* (2013.01); *F02B 2075/025* (2013.01)

(58) Field of Classification Search
CPC ..... F02B 75/28; F02B 75/02; F02B 2075/025
USPC ..... 123/51 B, 53.2, 51 BA, 51 BB
See application file for complete search history.

(56) References Cited

U.S. PATENT DOCUMENTS 1,419,688 A * 6/1922 Peigler ..... F02B 25/00 123/143 R
1,501,393 A 7/1924 Burtnett
1,578,476 A * 3/1926 Slaght ..... F01B 7/14 123/51 B
1,614,867 A * 1/1927 Bronander ..... F01B 7/14 123/51 BA
1,649,806 A 11/1927 Bronander
(Continued)

OTHER PUBLICATIONS

Ralph Hosier's TechnoBlog. Opposed Pistons. Dated Jun. 10, 2011. [Retrieved on Aug. 6, 2016]. Retrieved from the Internet. <URL: https://ralphhosier.wordpress.com/2011/06/10/opposed-pistons/>.

*Primary Examiner* — Marguerite McMahon
(74) *Attorney, Agent, or Firm* — Harness, Dickey & Pierce, P.L.C.

(57) ABSTRACT

An opposed-piston, two-stroke engine is provided and includes a first cylinder having a first longitudinal axis and a first pair of pistons slidably disposed within the first cylinder and movable toward one another in a first mode of operation and away from one another in a second mode of operation. The engine additionally includes a second cylinder having a second longitudinal axis and a second pair of pistons slidably disposed within the second cylinder and movable toward one another in the first mode of operation and away from one another in the second mode of operation. A crankshaft is connected to at least one of the first pair of pistons and at least one of the second pair of pistons and has an axis of rotation. The axis of rotation is disposed between and is substantially perpendicular to the first longitudinal axis and the second longitudinal axis.

22 Claims, 5 Drawing Sheets

(56) References Cited

U.S. PATENT DOCUMENTS

| | | | | | |
|---|---|---|---|---|---|
| 1,998,706 | A | * | 4/1935 | Campbell | B22D 19/00 123/41.72 |
| 2,054,232 | A | | 9/1936 | Schneider et al. | |
| 2,067,049 | A | * | 1/1937 | Goldberg | F01B 7/14 123/51 BB |
| 2,392,464 | A | * | 1/1946 | Daub | F02B 25/12 123/51 A |
| 2,412,952 | A | * | 12/1946 | Daub | F01B 7/14 123/51 BB |
| 2,419,531 | A | * | 4/1947 | Bronander | F01B 7/14 123/51 BB |
| 2,451,322 | A | | 10/1948 | Daub | |
| 2,706,970 | A | | 4/1955 | Rinne | |
| 2,800,270 | A | * | 7/1957 | Petersen | F02B 75/28 123/46 B |
| 2,911,964 | A | * | 11/1959 | Prescott | F01B 7/12 123/41.65 |
| 4,258,669 | A | * | 3/1981 | Noguchi | F02B 25/08 123/51 BA |
| 4,419,969 | A | * | 12/1983 | Bundrick, Jr. | F01B 7/04 123/48 A |
| 5,213,067 | A | | 5/1993 | Kramer | |
| 5,809,864 | A | | 9/1998 | Ashton | |
| 7,234,423 | B2 | | 6/2007 | Lindsay | |
| 2012/0285422 | A1 | | 11/2012 | Exner et al. | |
| 2013/0068190 | A1 | * | 3/2013 | Baindl | F02B 61/02 123/193.5 |
| 2013/0276762 | A1 | | 10/2013 | Hofbauer | |
| 2016/0032822 | A1 | | 2/2016 | McClearen et al. | |
| 2016/0032861 | A1 | | 2/2016 | Fuqua | |

* cited by examiner $$L_0 = (\#_{cyl} - 1) * EBS + OD_{liner}$$

where $$EBS = \sqrt{(OD_{liner} + L_{gap})^2 - (L_1)^2} \quad \text{(Effective Bore Spacing)}$$

CYLINDER ARRANGEMENT FOR OPPOSED PISTON ENGINE

CROSS-REFERENCE TO RELATED APPLICATIONS

This application claims the benefit of U.S. Provisional Application No. 62/031,935, filed on Aug. 1, 2014. The entire disclosure of the above application is incorporated herein by reference.

FIELD

The present disclosure relates to an opposed-piston engine and more particularly to an opposed-piston, two-stroke engine including off-set cylinders.

BACKGROUND

This section provides background information related to the present disclosure and is not necessarily prior art.

Opposed-piston, two-stroke engines include two pistons housed within a single cylinder that move in an opposed, reciprocal manner within the cylinder. In this regard, during one stage of operation, the pistons are moving away from one another within the cylinder. During another stage of operation, the pistons are moving towards one another within the cylinder.

As the pistons move towards one another within the cylinder, they compress and, thus, cause ignition of a fuel/air mixture disposed within the cylinder. In so doing, the pistons are forced apart from one another, thereby exposing inlet ports and outlet ports formed in the cylinder. Exposing the inlet ports draws air into the cylinder and expels exhaust, thereby allowing the process to begin anew.

When the pistons are forced apart from one another, connecting rods respectively associated with each piston transfer the linear motion of the pistons relative to and within the cylinder to one or more crankshafts associated with the connecting rods. The forces imparted on the crankshafts cause rotation of the crankshafts which, in turn, cause rotation of wheels of a vehicle in which the engine is installed.

Generally speaking, opposed-piston, two-stroke engines used in a vehicle include a bank of cylinders with each cylinder having a pair of pistons slidably disposed therein. While the engine may include any number of cylinders, the particular number of cylinders included is generally dictated by the type and/or required output of the vehicle. For example, in an automobile, fewer cylinders may be required when compared to a military vehicle such as a tank to properly propel and provide adequate power to the vehicle. Accordingly, an automobile may include an engine having four (4) cylinders and eight (8) pistons while a tank may include six (6) cylinders and twelve (12) pistons.

While conventional opposed-piston, two-stroke engines used in vehicles provide adequate power to the particular vehicle, such engines are often difficult to package within an engine compartment of the vehicle. Namely, the cylinders of conventional opposed-piston, two-cylinder engines are typically disposed along a single, longitudinal axis that passes through a center of each cylinder. While this arrangement does not hinder operation of the engine, the overall length of the engine is difficult to package within an engine compartment. Accordingly, the number and size of the cylinders in an opposed-piston, two-stroke engine is often limited by available packaging space within an engine compartment. As a result, use of such engines in vehicle applications is not widespread.

SUMMARY

This section provides a general summary of the disclosure, and is not a comprehensive disclosure of its full scope or all of its features.

An opposed-piston, two-stroke engine is provided and includes a first cylinder having a first longitudinal axis and a first pair of pistons slidably disposed within the first cylinder and movable along the first longitudinal axis toward one another in a first mode of operation and away from one another along the first longitudinal axis in a second mode of operation. The engine additionally includes a second cylinder having a second longitudinal axis and a second pair of pistons slidably disposed within the second cylinder and movable along the second longitudinal axis toward one another in the first mode of operation and away from one another along the second longitudinal axis in the second mode of operation. A crankshaft is connected to at least one of the first pair of pistons and at least one of the second pair of pistons and has an axis of rotation. The axis of rotation is disposed between and is substantially perpendicular to the first longitudinal axis and the second longitudinal axis.

In another configuration, an opposed-piston, two-stroke engine is provided and includes a first cylinder having a first longitudinal axis and a first pair of pistons slidably disposed within the first cylinder and movable along the first longitudinal axis toward one another in a first mode of operation and away from one another along the first longitudinal axis in a second mode of operation. The engine additionally includes a second cylinder having a second longitudinal axis and a second pair of pistons slidably disposed within the second cylinder and movable along the second longitudinal axis toward one another in the first mode of operation and away from one another along the second longitudinal axis in the second mode of operation. The engine also includes a third cylinder having a third longitudinal axis and a third pair of pistons slidably disposed within the third cylinder and movable along the third longitudinal axis toward one another in the first mode of operation and away from one another along the third longitudinal axis in the second mode of operation. A crankshaft is connected to at least one of the first pair of pistons, at least one of the second pair of pistons, and at least one of the third pair of pistons and has an axis of rotation. The first longitudinal axis, the second longitudinal axis, and the third longitudinal axis extend substantially perpendicular to the axis of rotation with the first longitudinal axis and the third longitudinal axis being disposed on an opposite side of the axis of rotation than the second longitudinal axis.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
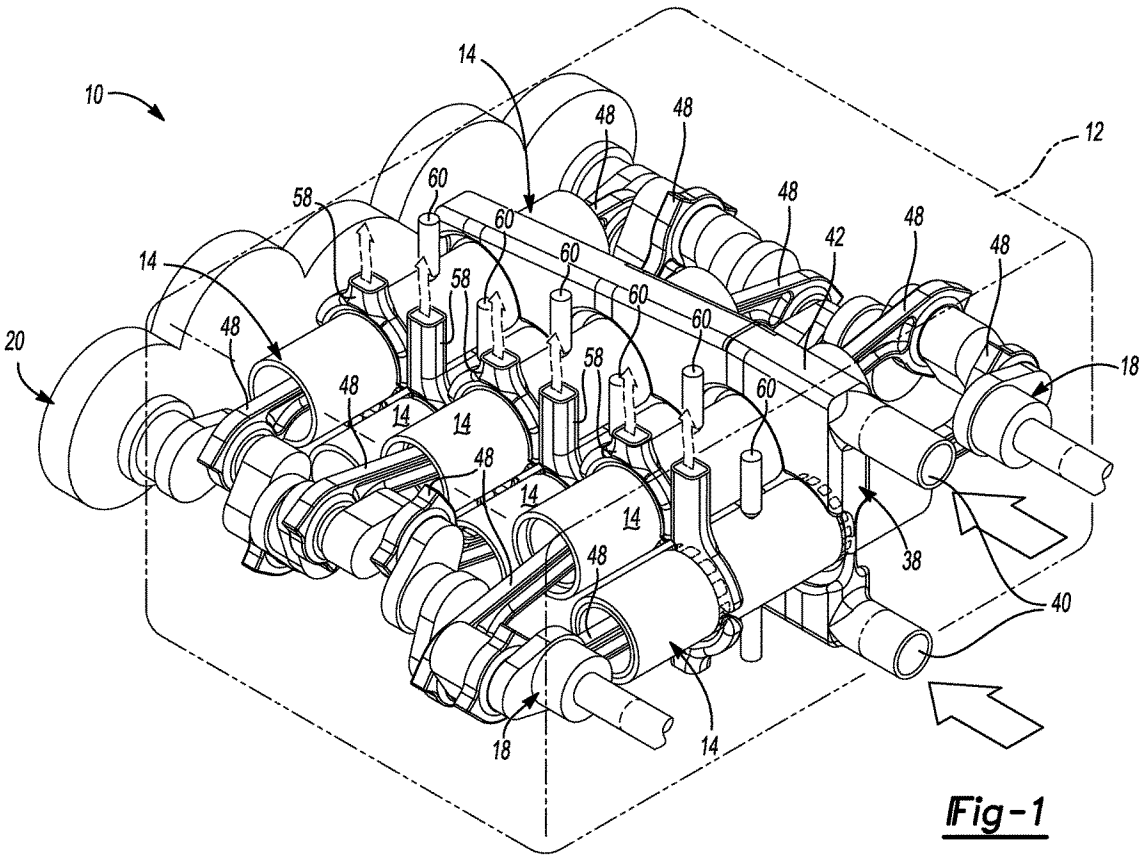
FIG. 1 is a perspective view of an opposed-piston, two-stroke engine in accordance with the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 4:
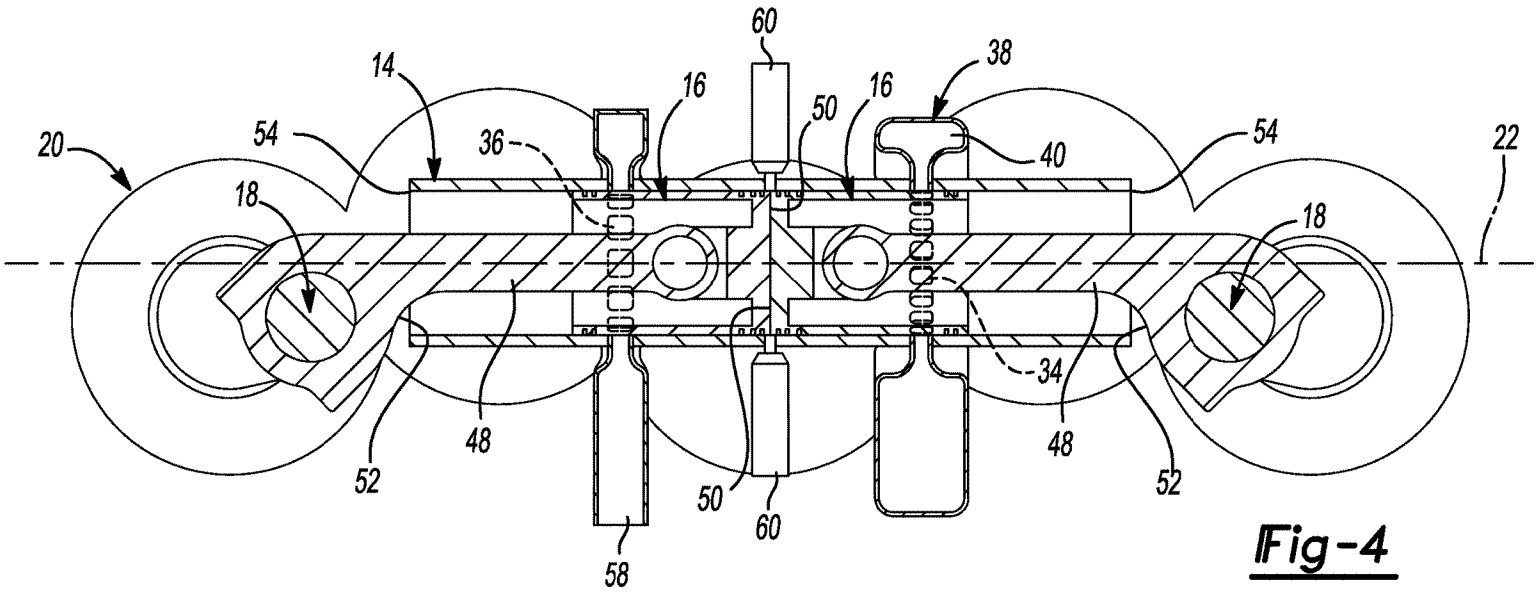
FIG. 4 is a cross-sectional view of the opposed-piston, two-stroke engine of FIG. 1 taken along line 4-4 of FIG. 2.
Figure 5:
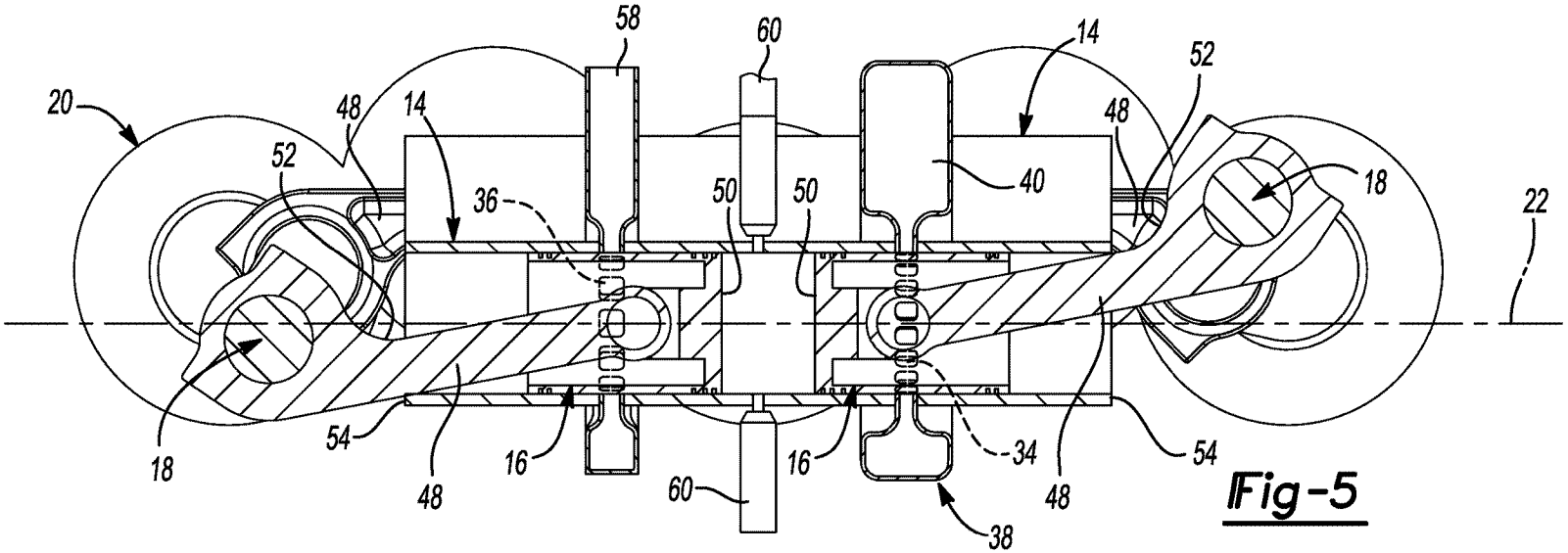
FIG. 5 is a cross-sectional view of the opposed-piston, two-stroke engine of FIG. 1 taken along line 5-5 of FIG. 2.

With reference to the figures, an opposed-piston, two-stroke engine 10 is provided and includes an engine block 12 having a series of cylinders 14. Each cylinder 14 includes a pair of pistons 16 slidably disposed therein and selectively movable toward one another (FIG. 4) and away from one another (FIG. 5). Movement of the pistons 16 relative to and within the cylinders 14 drives a pair of crankshafts 18 which, in turn, drive a gear train 20. The gear train 20 may be connected to driven wheels of a vehicle (neither shown), for example, whereby the crankshafts 18 and the gear train 20 cooperate to transform the linear motion of the pistons 16 relative to and within the cylinders 14 into rotational motion to allow the motion of the pistons 16 to rotate the driven wheels and propel the vehicle.

Figure 2:
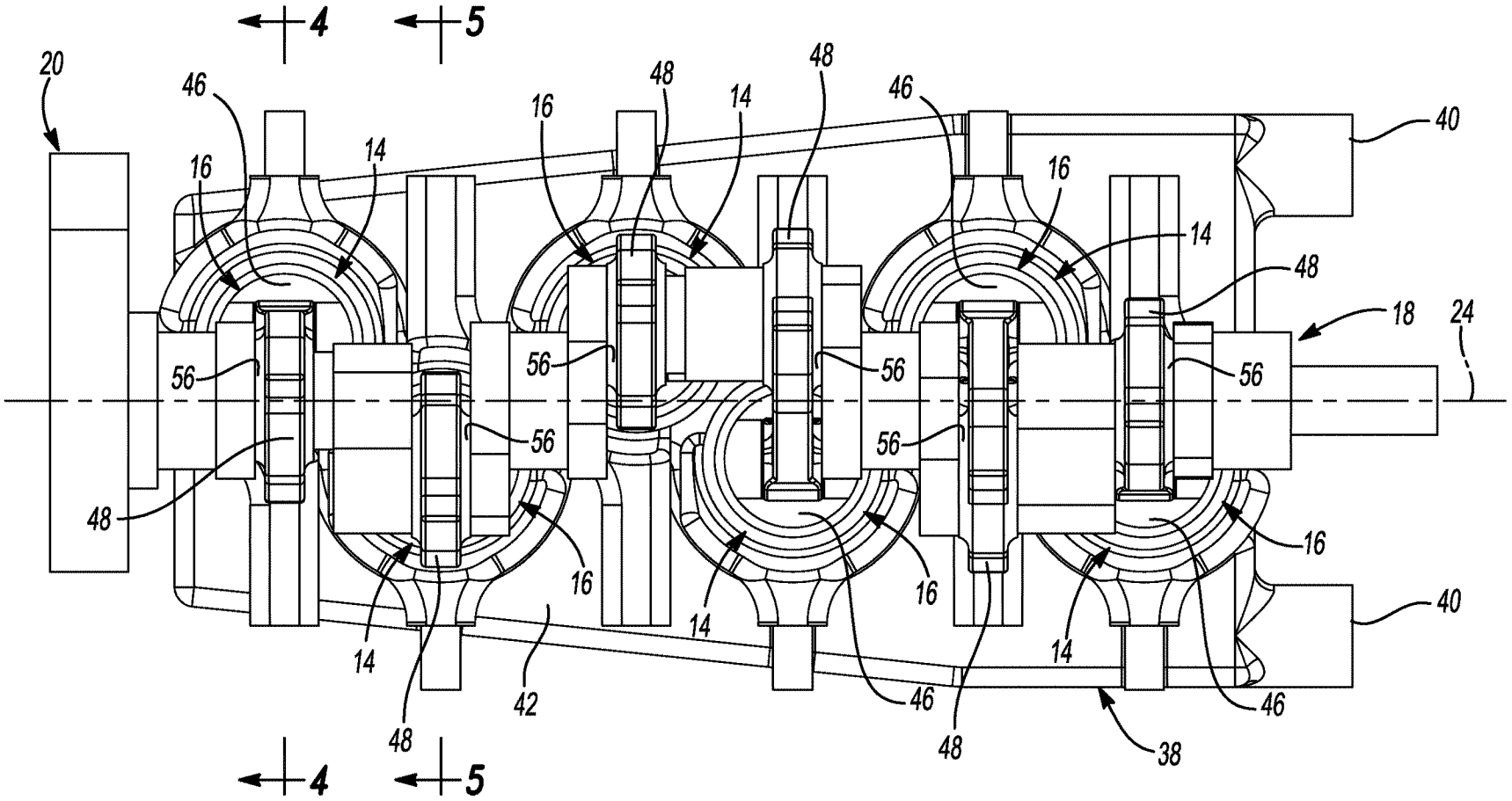
FIG. 2 is a side view of the opposed-piston, two-stroke engine of FIG. 1 showing an arrangement of cylinders of the engine.
Figure 6:
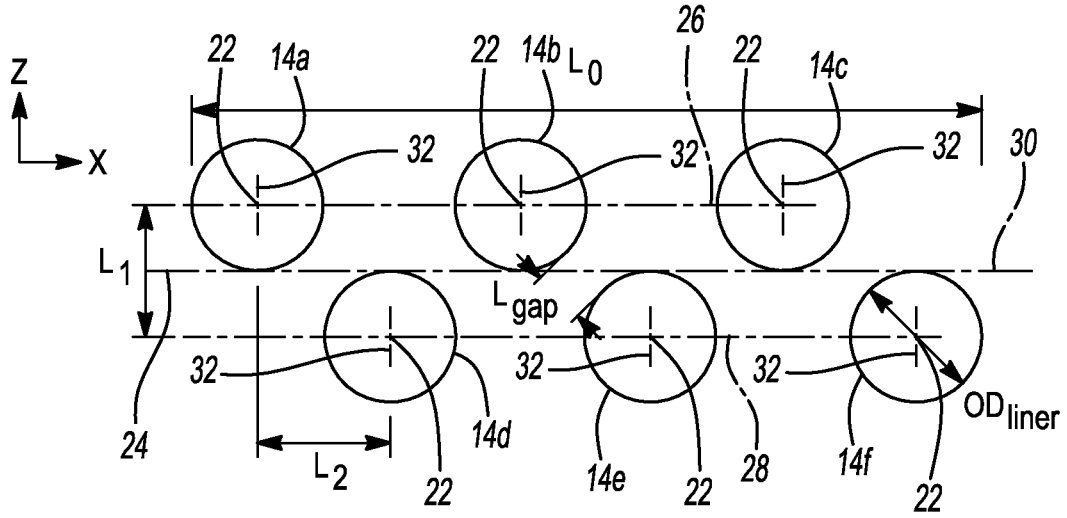
FIG. 6 is a schematic representation of a cylinder layout of the opposed-piston, two-stroke engine of FIG. 1.

The cylinders 14 are housed within the block 12 and each includes a longitudinal axis 22 (FIGS. 4-7) that extends substantially perpendicular to a rotational axis 24 of each crankshaft 18. As shown in FIGS. 2 and 6, the cylinders 14 are offset from one another such that some of the cylinders 14 are disposed between a pair of adjacent cylinders but are offset from one another. Namely, the cylinders 14 include six cylinders 14*a*, 14*b*, 14*c*, 14*d*, 14*e*, 14*f* in the example provided. The cylinders 14*a*, 14*b*, 14*c* are all disposed on an opposite side of the rotational axis 24 of the crankshafts 18 than the cylinders 14*d*, 14*e*, 14*f*. Further, the cylinder 14*d* is disposed between the cylinders 14*a*, 14*b* and the cylinder 14*e* is disposed between the cylinders 14*b*, 14*c* in a direction ($L_0$) extending substantially parallel to the rotational axis 24 of the crankshafts 18. Accordingly, the configuration of the cylinders 14*a*-14*f* shown in FIG. 6 creates a so-called "nested" arrangement of the cylinders 14*a*-14*f*, which allows the cylinders 14*a*-14*f* to be packaged in a smaller engine block 12 than if each of the centers of the cylinders 14*a*-14*c*—coaxially aligned with the longitudinal axes 22 of each cylinder 14—were aligned with one another in the direction ($L_0$).

As shown in FIG. 6, the longitudinal axes 22 of the cylinders 14*a*, 14*b*, 14*c* are aligned with one another such that a plane 26 extending through each axes 22 is substantially parallel to each axes 22 and is substantially parallel to the rotational axes 24 of the crankshafts 18. Similarly, a plane 28 intersecting the longitudinal axes 22 of the cylinders 14*d*, 14*e*, 14*f* is substantially parallel to the longitudinal axes 22 of the cylinders 14*d*, 14*e*, 14*f* and is substantially parallel to the rotational axes 24 of the crankshafts 18. As shown in FIG. 6, the plane 26 is substantially parallel to and is offset from the plane 28, as the plane 26 is disposed on an opposite side of the rotational axes 24 of the crankshafts 18 than the plane 28.

In one configuration, the crankshafts 18 are arranged on a plane 30 (FIG. 6) that is centered between the planes 26, 28. Accordingly, the crankshafts 18 extend between the cylinders 14*a*, 14*b*, 14*c* and the cylinders 14*d*, 14*e*, 14*f*. In the example shown in FIG. 6, the opposed-piston, two-stroke engine 10 includes six (6) cylinders 14 and, thus, twelve (12) pistons 16. Because the cylinders 14*a*-14*f* are arranged in a nested configuration, half of the cylinders 14*a*, 14*b*, 14*c* are disposed on an opposite side of the plane 30 and, thus, the rotational axes 24 of the crankshafts 18 from the other half of the cylinders 14*d*, 14*e*, 14*f*.

The nested arrangement of the cylinders 14*a*-14*f* allows some of the cylinders 14*a*-14*f* to be disposed between adjacent cylinders 14*a*-14*f* in the direction ($L_O$) extending substantially parallel to the rotational axis 24 of the crankshafts 18. For example, the cylinder 14*d* associated with the plane 28 is disposed between the cylinders 14*a*, 14*b* associated with the plane 26 in a direction extending substantially parallel to the planes 26, 28. Accordingly, a plane 32 extending through the axis 22 of each cylinder 14*a*-14*f* and in a direction substantially perpendicular to the planes 26, 28 of each cylinder 14*a*-14*f* does not intersect another cylinder 14*a*-14*f*. For example, the cylinder 14*d* disposed between the cylinders 14*a*, 14*b*, described above, includes a plane 32 extending through the longitudinal axis 22 of the cylinder 14*d* and in a direction substantially perpendicular to the planes 26, 28, 30, but does not intersect either of the cylinders 14*a*, 14*b*. Rather, and as shown in FIG. 6, the plane 32 of the cylinder 14*d* extends between the planes 32 of the cylinders 14*a*, 14*b*. In one configuration, the plane 32 extends between the cylinders 14*a*, 14*b* such that the plane 32 is equidistant from the longitudinal axes 22 of each cylinder 14*a*, 14*b*.

While the opposed-piston, two-stroke engine 10 is described and shown as including cylinders 14 that have a nested configuration, as shown in FIG. 6, such that the planes 32 of each cylinder 14*a*-14*f* are offset in a direction ($L_O$) substantially parallel to the rotation axis 24 of the crankshafts 18, the cylinders 14 could alternatively be positioned such that some of the planes 32 of adjacent cylinders 14 are aligned.

Figure 7:
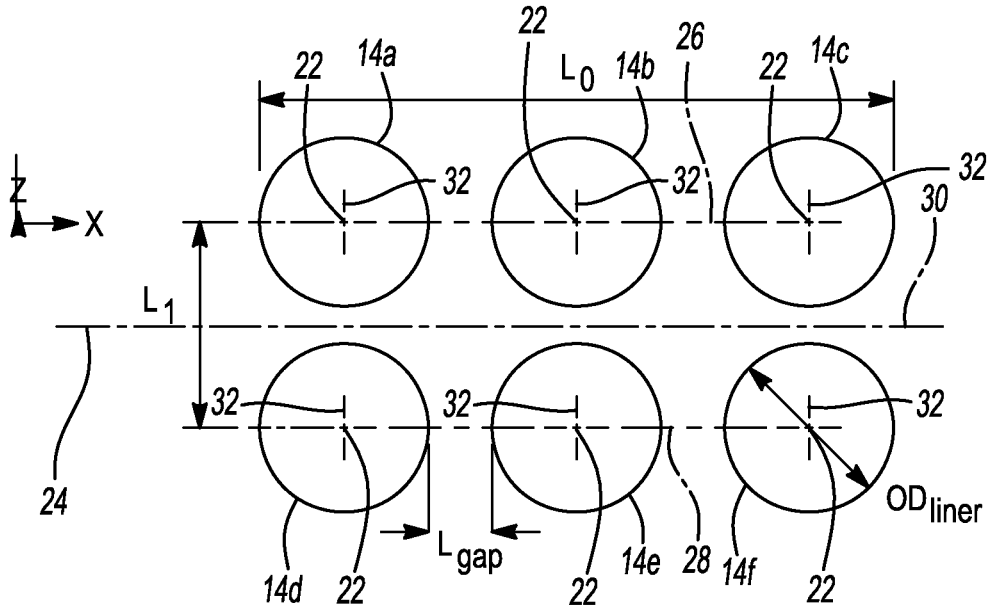
FIG. 7 is a schematic representation of another cylinder layout of the opposed-piston, two-stroke engine of FIG. 1.

As shown in FIG. 7, the plane 32 that extends through the longitudinal axis 22 of the cylinders 14 and substantially perpendicular to the planes 26, 28 intersects an adjacent cylinder 14. For example, the plane 32 of the cylinder 14*d* intersects the cylinder 14*a* at the plane 32 of the cylinder 14*a*. Accordingly, the cylinders 14*a*, 14*d* are aligned with one another, as the planes 32 of the cylinders 14*a*, 14*d* are parallel to one another and intersect one another. The remaining cylinders 14*b*, 14*c*, 14*e*, 14*f* are likewise aligned with one another, whereby the planes 32 of the cylinders 14*b*, 14*e* are aligned and the planes 32 of the cylinders 14*c*, 14*f* are aligned. While the opposed-piston, two-stroke engine 10 can have the cylinder arrangement shown in FIG. 6 or the cylinder arrangement shown in FIG. 7, the engine 10 will be described and shown as including the cylinder arrangement shown in FIG. 6.

The cylinders 14 each include a series of inlet ports 34 extending radially around and through an outer wall of the cylinders 14 and a series of outlet or exhaust ports 36 that similarly extend radially around and through the outer wall of each cylinder 14. The inlet ports 34 and the exhaust ports 36 are formed through the outer wall of the cylinders 14 to permit fluid communication through the wall of the cylinders 14 and into an interior of each cylinder 14.

The inlet ports 34 are in fluid communication with an intake manifold 38. The intake manifold 38 includes a pair of intake ports 40 that draw air into a body 42 of the intake manifold 38 which, in turn, communicates the air drawn into the intake ports 40 into each cylinder 14 via the inlet ports 34.

Figure 3:
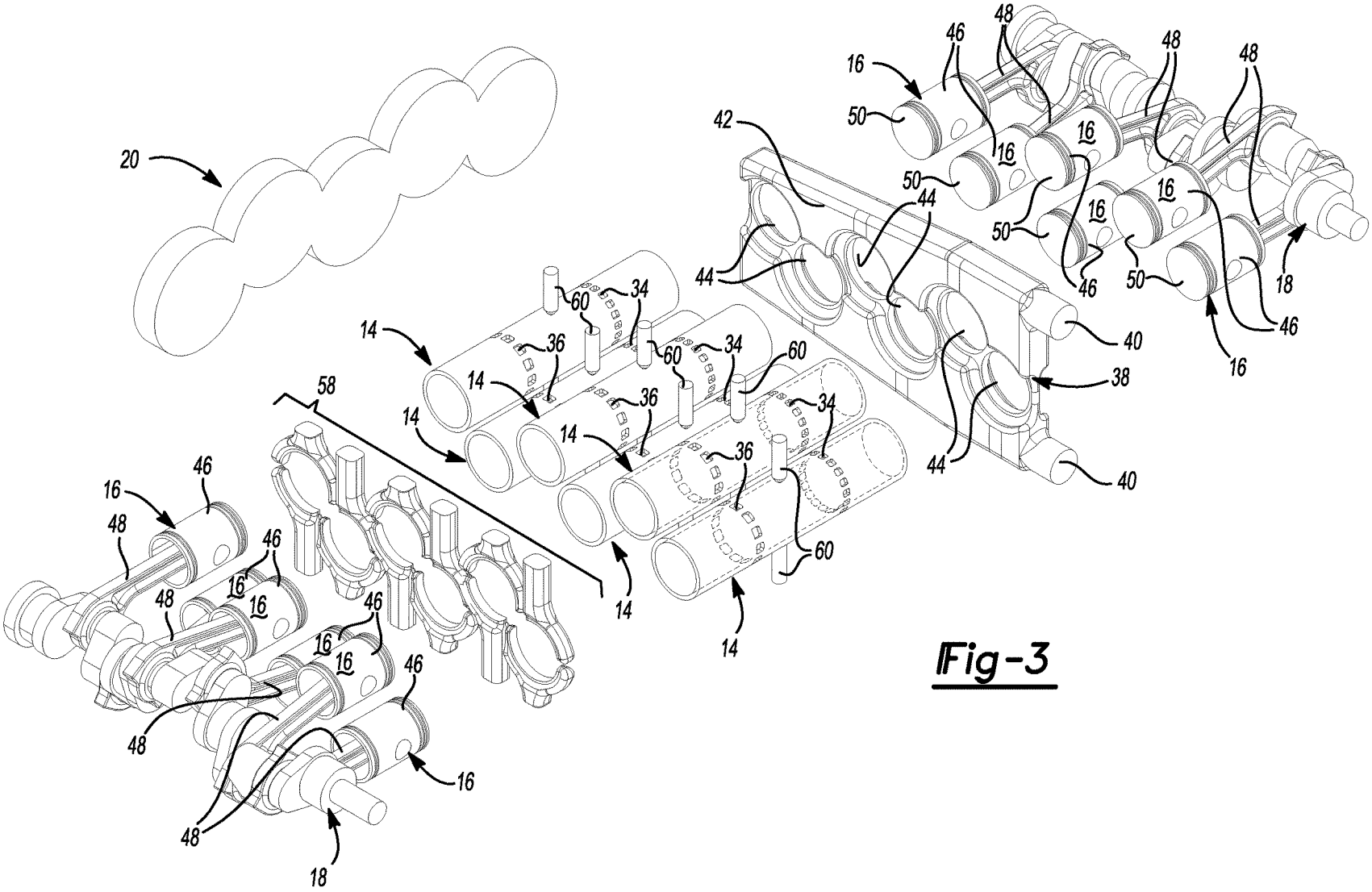
FIG. 3 is a partial exploded view of the opposed-piston, two-stroke engine of FIG. 1.

In one configuration, the body 42 includes a series of apertures 44 that are in fluid communication with the inlet ports 34 of the respective cylinders 14. The apertures 44 surround the cylinders 14 and are positioned along the longitudinal axis 22 of each cylinder 14 such that the apertures 44 oppose the inlet ports 34. In this way, air received by the body 42 from the intake ports 40 may be communicated to the cylinders 14 via the interface of the apertures 44 and the inlet ports 34 of each cylinder 14. As shown in FIGS. 1 and 3, the body 42 extends in a direction substantially perpendicular to the longitudinal axis 22 of each cylinder 14 and is in fluid communication with each of the cylinders 14 at the inlet ports 34. Accordingly, the intake manifold 38 provides air to each of the cylinders 14 without requiring an individual intake manifold for each cylinder 14.

In one configuration, the intake ports 40 receive a pressurized or charged stream of air from a supercharger (not shown). The supercharger directs pressurized air to the intake ports 40 of the intake manifold 38 to provide pressurized air to the cylinders 14 during operation of the opposed-piston, two-stroke engine 10, as will be described in greater detail below.

The pistons 16 are slidably disposed within the cylinders 14 and each includes a piston head 46 and a connecting rod 48. Once assembled, the piston heads 46 are slidably received within the cylinders 14 and are connected to a respective crankshaft 18 via a connecting rod 48. For example, and as shown in FIGS. 4 and 5, each cylinder 14 includes a pair of piston heads 46 and a pair of connecting rods 48. The piston heads 46 are slidably disposed within the cylinders 14 such that a distal end 50 of each piston head 46 opposes one another within the cylinder 14. The connecting rods 48 extend between the piston heads 46 and a respective crankshaft 18 and are rotatably attached to the piston heads 46 at a first end and are rotatably attached to the crankshafts 18 at a second end.

As described above, the crankshafts 18 may be disposed between the cylinders 14. For example, the crankshafts 18 may be disposed between a first bank of cylinders 14*a*, 14*b*, 14*c* and a second bank of cylinders 14*d*, 14*e*, 14*f*, as shown in FIG. 6. If the opposed-piston, two-stroke engine 10 includes the cylinder arrangement shown in FIG. 6, a single crankshaft 18 may be located at each end of the cylinders 14. As shown in FIG. 5, for example, the crankshafts 18 are shown as being connected to each piston head 46 via individual connecting rods 48 along the length of the crankshafts 18.

The crankshafts 18 may be coupled to each piston head 46 by positioning the crankshaft 18 at a location between the first bank of cylinders 14*a*, 14*b*, 14*c* and the second bank of cylinders 14*d*, 14*e*, 14*f* and, further, by providing each connecting rod 48 with a clearance or recess 52. The clearance or recess 52 allows the connecting rod 48 to extend past a distal end 54 of the cylinders 14 (FIG. 5) without causing contact between the cylinders 14 and the connecting rods 48. This allows the pivotable connection between the connecting rod 48 and the crankshaft 18 to be made at a location above or below the longitudinal axis 22 of each cylinder 14. This, in turn, allows the crankshafts 18 to be positioned above or below the longitudinal axis 22 of each cylinder 14, thereby allowing the crankshafts 18 to be attached to each piston head 46 along a length of one side of the engine 10, as shown in FIG. 2. In short, the rotational axis 24 of the crankshafts 18 is offset from the effective center of each cylinder 14 (i.e., is offset from the central, longitudinal axis 22 of each cylinder 14).

The crankshafts 18 are positioned on opposite sides of the opposed-piston, two-stroke engine 10. Each crankshaft 18 is rotatably attached to and is driven by the piston heads 46 during operation of the engine 10. As shown in FIG. 2, each crankshaft 18 includes a series of attachment locations 56 that attach the connecting rods 48 to the crankshafts 18 along a length of the crankshafts 18. As shown in FIG. 2, the attachment locations 56 may be aligned with the rotational axis 24 or, alternatively, may be offset from the rotational axis 24 of the crankshafts 18. Offsetting some of the attachment locations 56 of the crankshafts 18 from the rotational axis 24 of the crankshafts 18 allows the piston heads 46 to be in different locations within each cylinder 14 at any given time. For example, the piston heads 46 shown in FIG. 4 are positioned within their respective cylinder 14 such that the distal ends 50 of the opposed piston heads 46 are virtually in contact with one another while the distal ends 50 of the piston heads 46 shown in FIG. 5 are spaced apart from one another within their respective cylinder 14 at the same time. The piston heads 46 are permitted to be in the position shown in FIGS. 4 and 5 at the same time due to the offset of the attachment locations 56 of the connecting rods 48 to the crankshafts 18.

With particular reference to FIGS. 1, 4, and 5, operation of the opposed-piston, two-stroke engine 10 will be described in detail. During operation, the piston heads 46 may move toward one another (FIG. 4) and away from one another (FIG. 5) within each cylinder 14. When the piston heads 46 are sufficiently moved away from one another, the distal ends 50 of the piston heads 46 expose the inlet ports 34 and the exhaust ports 36 of the cylinder 14.

When the inlet ports 34 are exposed, pressurized air is received by the cylinders 14 via the inlet ports 34 due to the pressurized air supplied to the intake manifold 38 by the supercharger. The pressurized air flows into the cylinder 14 at the inlet ports 34 and, in so doing, forces exhaust gas disposed within the cylinder 14 out of the cylinders 14 via the exhaust ports 36. The exhaust gas exits the exhaust ports 36 and enters an exhaust manifold 58. As with the intake manifold 38, the exhaust manifold 58 surrounds each cylinder 14 and is in fluid communication with the cylinders 14 via the exhaust ports 36. Therefore, when the pressurized air enters the cylinders 14 at the inlet ports 34, the pressurized air causes the exhaust gas disposed within the cylinders 14 to exit the cylinders 14 and enter the exhaust manifold 58 via the exhaust ports 36.

When one of the cylinders 14 is in a position such that the inlet ports 34 and the exhaust ports 36 are exposed, one or more of the other piston heads 46 are in a position whereby the distal ends 50 are in close proximity to one another. Air disposed within these cylinders 14 is compressed due to movement of the piston heads 46 towards one another.

One or more fuel injectors 60 may be located along a length of each cylinder 14 at an area between each piston head 46 when the piston heads 46 are moved toward one another. Fuel may be injected into the cylinders 14 by the fuel injectors 60 at a location proximate to the distal end 50 of each piston head 46 such that when the air disposed within the cylinder 14 is compressed between the distal ends 50 of each piston head 46, fuel is mixed with the compressed air, thereby causing combustion.

When the fuel/air mixture combusts, a force is generated, thereby causing the piston heads 46 to move away from one another along the longitudinal axis 22 of the cylinder 14. In so doing, an axial force is applied to the respective connecting rods 48 of the piston heads 46 which, in turn, causes the particular crankshaft 18 to rotate. Rotation of the crankshaft 18 likewise causes movement of the other piston heads 46 attached to the crankshaft 18 due to the offset position of the attachment locations 56 of each connecting rod 48 to the crankshaft 18. Further, rotation of the crankshaft 18 likewise causes a rotational force to be applied to the gear train 20 which, in turn, causes a rotational force to be applied to driven wheels of a vehicle, for example.

When the distal ends 50 of each piston head 46 move apart from one another and the piston heads 46 sufficiently move along the longitudinal axis 22 in a direction away from one another, the inlet ports 34 and the exhaust ports 36 of the cylinder 14 are once again exposed and the cycle begins anew.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An opposed-piston engine comprising:

a first cylinder having a first longitudinal axis and a first outer diameter;

a first pair of pistons slidably disposed within said first cylinder and movable along said first longitudinal axis toward one another in a first mode of operation and away from one another along said first longitudinal axis in a second mode of operation;

a second cylinder having a second longitudinal axis and a second outer diameter;

a second pair of pistons slidably disposed within said second cylinder and movable along said second longitudinal axis toward one another in said first mode of operation and away from one another along said second longitudinal axis in said second mode of operation;

a third cylinder having a third longitudinal axis and a third outer diameter, said first and third cylinders having a first tangent line that is tangent to said first outer diameter of said first cylinder and third outer diameter of said third cylinder, wherein at least one of:

said first tangent line is also tangent to said second outer diameter of said second cylinder; and said first tangent line extends through said second cylinder;

a third pair of pistons slidably disposed within said third cylinder and movable along said third longitudinal axis toward one another in said first mode of operation and away from one another along said third longitudinal axis in said second mode of operation; and a first crankshaft operably connected to at least one of said first pair of pistons, at least one of said second pair of pistons, and at least one of said third pair of pistons and having a first axis of rotation that is substantially perpendicular to said first longitudinal axis, said second longitudinal axis, and said third longitudinal axis, said first axis of rotation being disposed between said first longitudinal axis and said second longitudinal axis and between said second longitudinal axis and said third longitudinal axis, wherein said first cylinder and said second cylinder are offset from one another in a first direction substantially parallel to said first axis of rotation and in a second direction substantially perpendicular to said first axis of rotation, and wherein said second cylinder and said third cylinder are offset from one another in said first direction and in said second direction.

2. The opposed-piston engine of claim 1, further comprising a second crankshaft operably connected to at least one of said first pair of pistons and at least one of said second pair of pistons and having a second axis of rotation, wherein said first and second axes of rotation are arranged within a plane that is disposed between said first and second longitudinal axes.

3. The opposed-piston engine of claim 1, wherein said first cylinder and said second cylinder are offset from one another in said first direction by an amount that is greater than a radius of at least one of said first cylinder and said second cylinder.

4. The opposed-piston engine of claim 3, wherein said amount is greater than the radius of said first cylinder and greater than the radius of said second cylinder.

5. The opposed-piston engine of claim 2, wherein said first and third cylinders are disposed on a first side of said plane, and said second cylinder is disposed on a second side of said plane that is opposite said first side.

6. The opposed-piston stoke engine of claim 1, wherein said first tangent line is tangent to said first outer diameter of said first cylinder, said second outer diameter of said second cylinder, and said third outer diameter of said third cylinder.

7. The opposed-piston engine of claim 1, wherein said first tangent line extends through said second cylinder.

8. An opposed-piston engine comprising:

a first cylinder having a first longitudinal axis and a first outer diameter;

a first pair of pistons slidably disposed within said first cylinder and movable along said first longitudinal axis toward one another in a first mode of operation and away from one another along said first longitudinal axis in a second mode of operation;

a second cylinder having a second longitudinal axis and a second outer diameter;

a second pair of pistons slidably disposed within said second cylinder and movable along said second longitudinal axis toward one another in said first mode of operation and away from one another along said second longitudinal axis in said second mode of operation;

a third cylinder having a third longitudinal axis and a third outer diameter, said first and third cylinders having a first tangent line that is tangent to said first outer diameter of said first cylinder and to said third outer diameter of said third cylinder, wherein at least one of:

said first tangent line is also tangent to said second outer diameter of said second cylinder; and said first tangent line extends through said second cylinder;

a third pair of pistons slidably disposed within said third cylinder and movable along said third longitudinal axis toward one another in said first mode of operation and away from one another along said third longitudinal axis in said second mode of operation; and a crankshaft operably connected to at least one of said first pair of pistons, at least one of said second pair of pistons, and at least one of said third pair of pistons and having an axis of rotation, said first longitudinal axis, said second longitudinal axis, and said third longitudinal axis extending substantially perpendicular to said axis of rotation with said first longitudinal axis and said third longitudinal axis being disposed on an opposite side of said axis of rotation than said second longitudinal axis.

9. The opposed-piston engine of claim 8, wherein said second cylinder is disposed between said first cylinder and said third cylinder in a direction substantially parallel to said axis of rotation.

10. The opposed-piston engine of claim 8, wherein said first longitudinal axis and said third longitudinal axis are disposed within a first plane that is substantially parallel to said axis of rotation.

11. The opposed-piston engine of claim 10, further comprising a fourth cylinder having a fourth longitudinal axis and a fourth pair of pistons disposed within said fourth cylinder and movable along said fourth longitudinal axis toward one another in said first mode of operation and away from one another along said fourth longitudinal axis in said second mode of operation, wherein said first and third cylinders are disposed on a first side of said axis of rotation, and said second and fourth cylinders are disposed on a second side of said axis of rotation that is opposite said first side.

12. The opposed-piston engine of claim 11, wherein said fourth cylinder is aligned with said second cylinder such that said second longitudinal axis and said fourth longitudinal axis are disposed within a second plane that is substantially parallel to said rotational axis of said crankshaft.

13. The opposed-piston engine of claim 12, wherein said first plane is disposed on said first side of said axis of rotation, and said second plane is disposed on said second side of said axis of rotation.

14. The opposed-piston engine of claim 13, wherein said first longitudinal axis is aligned with said second longitudinal axis such that a third plane extending through said first longitudinal axis and said second longitudinal axis extends substantially perpendicular to said axis of rotation.

15. The opposed-piston engine of claim 13, wherein said second cylinder is disposed between said first cylinder and said third cylinder in a direction substantially parallel to said axis of rotation.

16. The opposed-piston engine of claim 8, wherein said first tangent line is tangent to said first outer diameter of said first cylinder, said second outer diameter of said second cylinder, and said third outer diameter of said third cylinder.

17. The opposed-piston engine of claim 8, wherein said first tangent line extends through said second cylinder.

18. The opposed-piston engine of claim 11, wherein said fourth cylinder has a fourth outer diameter, said second and fourth cylinders have a second tangent line that is tangent to said second outer diameter of said second cylinder and said fourth outer diameter of said fourth cylinder, and wherein at least one of:

said second tangent line is collinear with said first tangent line; and said first tangent line extends through said second and fourth cylinders; and said second tangent line extends through said first and third cylinders.

19. An opposed-piston engine comprising:

a first plurality of cylinders having a first tangent line that is tangent to a first outer diameter of each of said first plurality of cylinders;

a first pair of pistons disposed within each of said first plurality of cylinders;

a second plurality of cylinders having a second tangent line that is tangent to a second outer diameter of each of said second plurality of cylinders;

a second pair of pistons disposed within each of said second plurality of cylinders; and a first crankshaft connected to at least one of (i) one of said first pair of pistons in each of said first plurality of cylinders and (ii) one of said second pair of pistons in each of said second plurality of cylinders, said first crankshaft having a first axis of rotation, said second plurality of cylinders being offset from said first plurality of cylinders in a direction that is perpendicular to said first axis of rotation, wherein at least one of:

a distance between said first and second tangent lines is equal to zero;

said first tangent line extends through said second plurality of cylinders; and said second tangent line extends through said first plurality of cylinders.

20. The opposed-piston engine of claim 19 wherein:

said first tangent line extends through said second plurality of cylinders; and said second tangent line extends through said first plurality of cylinders.

21. The opposed-piston engine of claim 19 further comprising a second crankshaft connected to at least one of (i) the other one of said first pair of pistons in each of said first plurality of cylinders and (ii) the other one of said second pair of pistons in each of said second plurality of cylinders, said second crankshaft having a second axis of rotation, wherein:

said first and second axes of rotation are arranged within a plane; and said first plurality of cylinders are disposed on a first side of said plane; and said second plurality of cylinders are disposed on a second side of said plane that is opposite of said first side.

22. The opposed-piston engine of claim 21, wherein the first and second tangent lines are also arranged within said plane.

* * * * *